United States Patent [19]

Bancroft

[11] 4,257,605

[45] Mar. 24, 1981

[54] ROLLABLE BODY

[76] Inventor: Donald G. Bancroft, R.R. #1 - Apt. 82, Macomb, Ill. 61455

[21] Appl. No.: 84,999

[22] Filed: Oct. 15, 1979

[51] Int. Cl.[3] ..... A63B 71/00

[52] U.S. Cl. ..... 273/128 A; 46/211; 273/109; 273/86 C; 273/359

[58] Field of Search ..... 273/128 R, 128 A, 58 D, 273/58 K; 46/1 R, 211, 201

[56] References Cited

U.S. PATENT DOCUMENTS

| | | | |
|---|---|---|---|
| 3,046,016 | 7/1962 | Laws | 273/58 D |
| 3,073,598 | 1/1968 | Tikkainen | 273/58 D |

*Primary Examiner*—Richard C. Pinkham
*Assistant Examiner*—T. Brown
*Attorney, Agent, or Firm*—Merriam, Marshall & Bicknell

[57] ABSTRACT

The present invention comprises a rollable article or device formed essentially of two interconnected members or sections of substantially equal weight which extend outwardly in diametrically opposite directions and each providing an outer bearing surface or supporting edge surface in the form of a uniformly curved arc, such as a semi-circular arc having a length of about 180°, with each of the supporting edge surfaces lying in separate planes which are perpendicular intersecting planes, preferably also perpendicular to a plane containing the ends of the supporting edge surfaces, and with said article having no portion thereof other than said supporting edges providing a bearing surface or support for the article when the article is placed on a flat or planar surface. The rollable article exhibits a wobbling motion when rolled down an inclined planar surface.

10 Claims, 12 Drawing Figures

FIG. 13
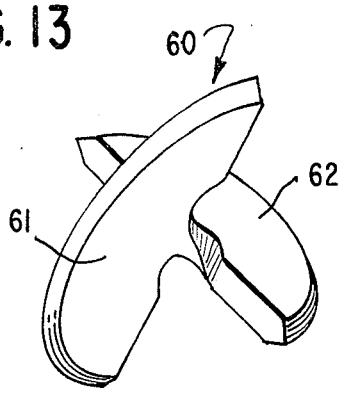
FIG. 2
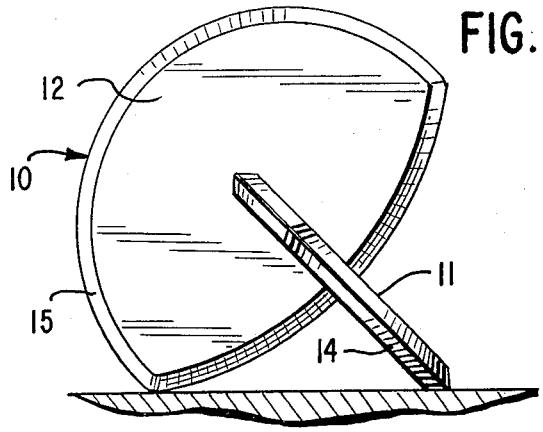
FIG. 3
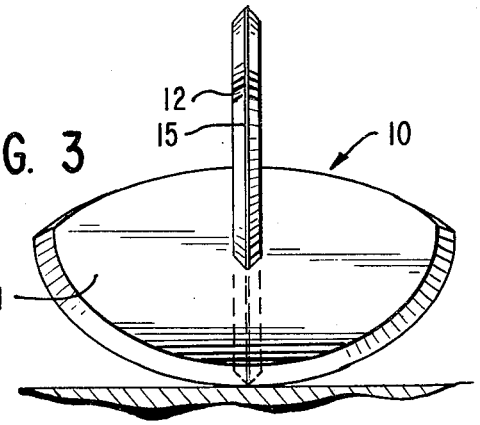
FIG. 4
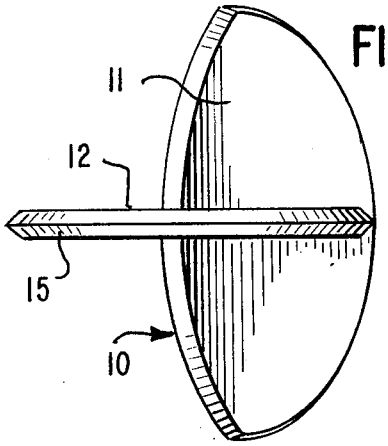
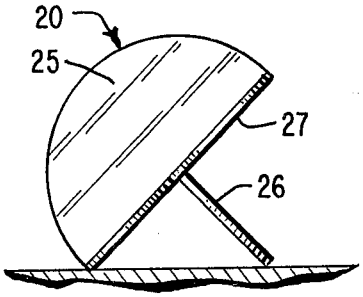
FIG. 5
FIG. 6
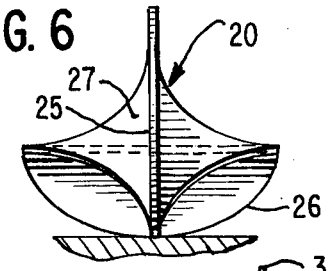
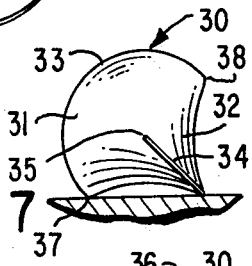
FIG. 7
FIG. 8
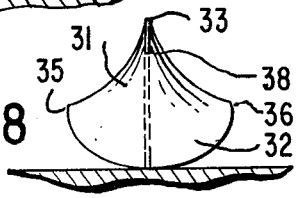
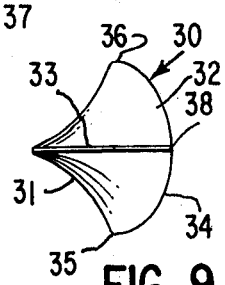
FIG. 9
FIG. 10
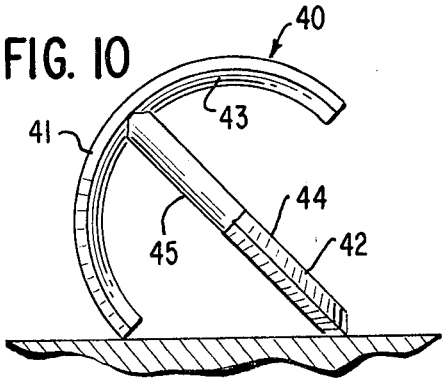
FIG. 11
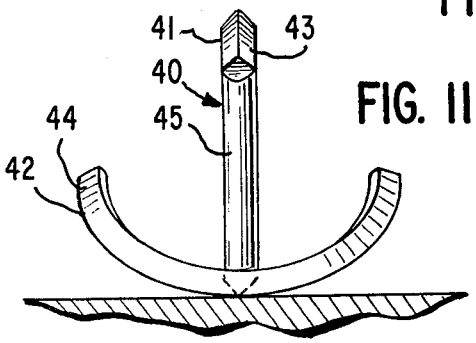

ROLLABLE BODY

The present invention relates generally to a rollable article and more particularly to an amusement device, game piece of movable target structure which has an unusual behavior when rolled on an inclined flat surface and which can be used in a variety of amusement and practical ways.

Although various play balls have been designed to bounce or roll in an unusual manner, the structures used heretofore have been relatively complicated or require a relatively large mass to effect the desired movement. Consequently, the cost of making such devices has been relatively high.

It is therefore an object of the present invention to provide an inexpensive rollable article having an unusual pattern of movement when rolled over a flat surface.

It is also an object of the present invention to provide a rollable article which is simple in design and of durable construction.

A further object of the present invention is to provide a rollable article which presents to view areas thereof which change significantly in size and position as the device is rolled along an inclined flat surface.

Other objects of the invention will be apparent to those skilled in the art from the following specification and claims when read in conjunction with the accompanying drawing, wherein:

FIG. 2 is a front elevational view of the rollable device of FIG. 1 supported on a flat surface.

FIG. 3 is a right side elevational view of the rollable device of FIG. 1 supported on a flat surface;

FIG. 4 is a top plan view of the device of FIG. 2;

FIG. 5 is a front elevational view of a modified form of the rollable device supported on a flat surface;

FIG. 6 is a left side elevational view of the rollable device of FIG. 5;

FIG. 7 is a front elevational view of a further modified form of the present invention supported on a flat surface;

FIG. 8 is a right side elevational view of the device of FIG. 7;

FIG. 9 is a top plan view of the device of FIG. 7;

FIG. 10 is a front elevational view of still another modified form of the present invention;

FIG. 11 is a right side elevational view of the rollable device of FIG. 10;

FIG. 13 is a perspective view of a further modified form of rollable article;

Figure 1:
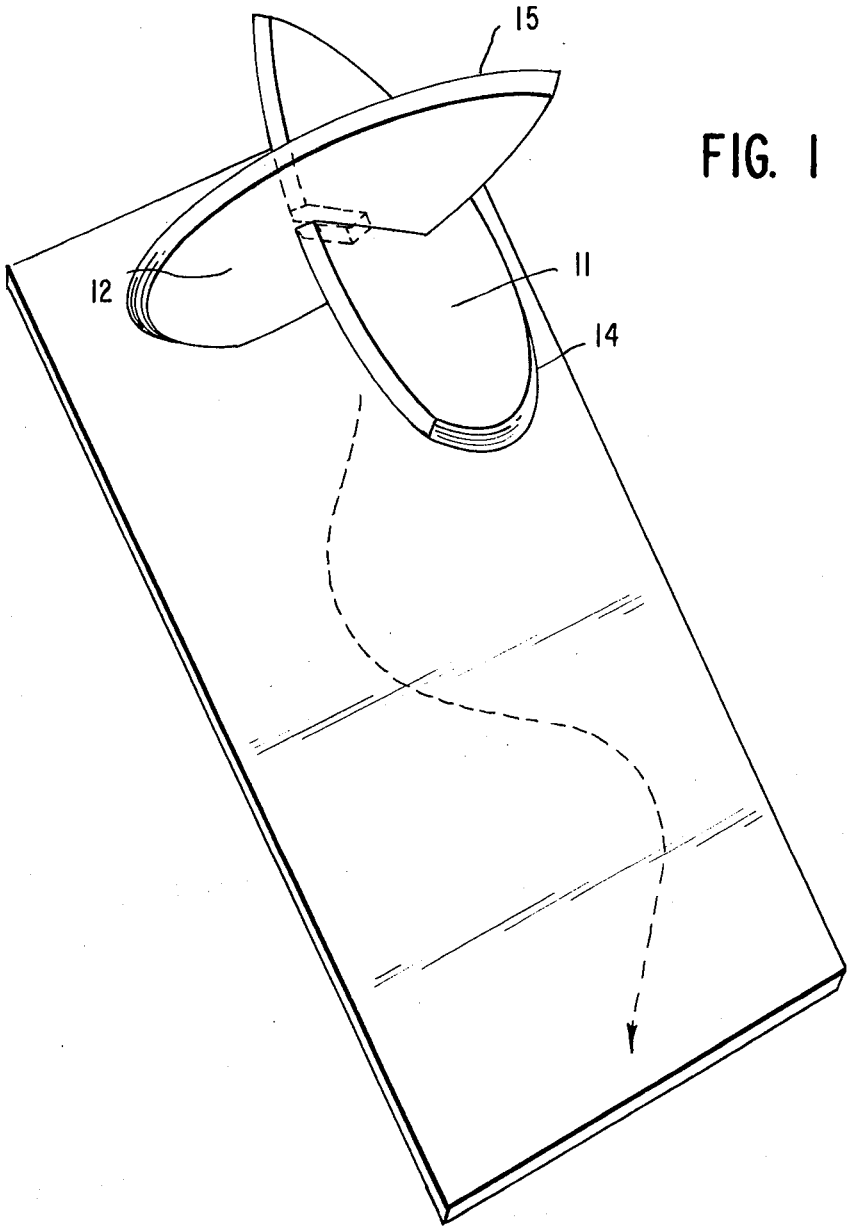
FIG. 1 is a perspective view of a rollable article embodying the present invention.

The present invention comprises a rollable article or device formed essentially of two interconnected members or sections of substantially equal weight which extend outwardly in diametrically opposite directions and each providing an outer bearing surface or supporting edge surface in the form of a uniformly curved arc, such as a semi-circular arc having a length of about 180°, with each of the supporting edge surfaces lying in separate planes which are perpendicular intersecting planes, preferably also perpendicular to the plane containing the ends of the supporting edge surfaces, and with said article having no portion thereof other than said supporting edges providing a bearing surface or support for the article when the article is placed on a flat or planar surface.

In the form of the invention shown in FIGS. 1–4 the rollable body 10 is formed of two symmetrical planar semi-circular shaped sections 11, 12 which are integrally formed or interconnected at the midpoint of each diameter line, as by having slots in each section 11, 12, so that each section 11, 12 lies in a separate substantially perpendicular intersecting plane. Each semi-circular section 11, 12 provides a bearing surface 14, 15, respectively, extending along the outer periphery thereof. The bearing surfaces 14, 15 are preferably formed by having the periphery of the sections 11, 12 bevelled so as to provide a flat contact surface for engagement with the supporting inclined surface. If desired, however, the bearing surface 14, 15 can be rounded to provide a line contact surface. If the intersecting planes in which section 11, 12 are disposed are not perpendicular to each other and perpendicular to a plane containing the ends of a bearing surface 14, 15, the body 10 will not roll in a straight line.

The rollable body 20 shown in FIGS. 5 and 6 is formed of two symmetrical planar semi-circular sections 25, 26 each disposed in separate substantially perpendicular intersecting planes and interconnected by a planar section 27. The planar section 27 has a generally square configuration having diagonals which are equal to the length of the diameter of sections 25, 26. The semi-circular section 25 is secured to one surface of the planar section 27 extending outwardly along one diagonal thereof and perpendicular to the plane of section 27. The semi-circular section 26 is secured to the opposite surface of planar section 27 extending outwardly along the other diagonal of section 27 and perpendicular to the plane of the section 27. As best shown in FIG. 6, the sides of the planar section 27 have a concave configuration so that the body is supported at all times only by one of the semi-circular supporting edge surfaces of section 25, 26 and the end of the other supporting edge surface.

FIGS. 7–9 show a further modified form of the invention in which the rollable body 30 is formed of an upper section 31 and a lower section 32 providing semi-circular supporting edges 33, 34, respectively, with the supporting edges 33, 34 lying in intersecting perpendicular planes. The rollable body 30 differs only in form from the body shown in FIGS. 1–4 in that the outer surface of the upper end and lower sections 31, 32 are defined by lines having a concave curvature extending from the supporting edge 33 of the upper section 31 to the opposite ends 35, 36 of the supporting edge 34 on the lower section and with the outer surface of the lower section 32 being defined by lines having a concave curvature extending from the supporting edge 34 to the opposite ends 37, 38 of the supporting edge 33 on the upper section 31.

In FIGS. 10–11 the rollable body 40 is formed of an upper section 41 and a lower section 42 comprised of form-retaining rods or tubular members 43, 44, respectively, bent in the form of a semi-circular arc having a support surface formed along the outer edge and interconnected by a rigid support rod 45 extending from the midpoint of each of the members 43, 44 with the members 43, 44 lying in intersecting perpendicular planes and said planes also being perpendicular to the plane containing the ends of the members 43, 44.

Figure 12:
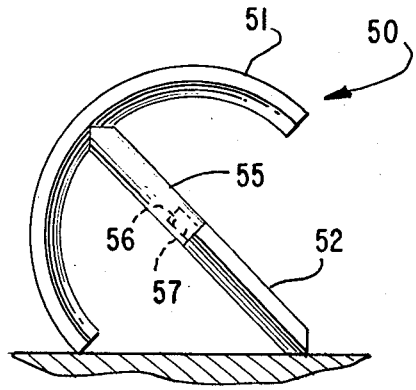
FIG. 12 is a front elevational view of another modified form of rollable article.

The rollable body 50 shown in FIG. 12 is formed of upper and lower sections 51, 52, respectively, similar to the form and structure of section 41, 42 of FIGS. 10–11, but wherein the support rod 55 connecting sections 51, 52 is segmented at about the mid-point with one end provided with a socket 56 adapted to frictionally engage a pin 57 formed on the end of the other segment. The male-female friction connection allows relative pivotal adjustment of the sections 51, 52 so that the body 50 when rolled down an inclined planar surface will move along a curved path.

In FIG. 13, the rollable body 60 is formed of a flat circular piece of plastic or metal material which is cut to form two semi-circular sections 61, 62, respectively, connected at their mid-point by a narrow section of the plastic or metal and having the sections 61, 62 rotated 90° relative to each other so that the sections 61, 62 are disposed in separate intersecting planes which are perpendicular to each other and perpendicular to the plane containing the ends of the diameter lines of each section 61, 62.

As best illustrated in FIG. 1, each of the forms of the invention shown in the drawing when placed on an inclined flat surface will roll downwardly by having the curved bearing surfaces or edge portions of each section alternately moves over the flat supporting surface as the body pivots about the end point on the other support section so as to provide a side-to-side wobbling motion, as each support surface successively comes into contact with the inclined supporting flat surface.

The rollable device of the present invention can be made in any size and of any suitable material but preferably is formed of a rigid or semi-rigid material, such as plastic, wood or metal in order to provide a form-retaining structure. The sections forming the rollable body can be integrally formed, as by molding from plastic or metal, or if desired, each section can be formed separately and joined at the mid-point thereof by a suitable adhesive fastener or connector means.

Whereas the forms of the invention shown in the drawing employed two symmetrically shaped sections of substantially equal size and weight having a semi-circular supporting edge, it should be understood that one section can have a supporting surface or edge portion which has a curvature different from that of the other supporting edge surface. When the support sections have different radii, the rollable device will not roll along a straight line course but will curve to one side of a straight line course. When sections of different radii are used each section preferably has substantially the same weight and the radii preferably should not differ greatly in order to facilitate uniform rolling. Also, when there is slippage during the rolling movement with a device having identical support surfaces, the rollable device will depart from a straight line course when rolled along an inclined surface.

The rollable device of the present invention can be used as an amusement device or as a game piece for rolling on the surface of a flat game board. As an example of the use of the device as a game piece, a player holds a flat game board upon which are placed two rollable devices of the type shown in FIGS. 1–4 positioned so that the rollable devices when rolled directly across the board will cross perpendicular to the path of the other rollable device. The player who can roll the devices alternately cross the path of the other rollable device the most times in a given time period is the winner.

As a further example, each player holds a flat game board on which is placed a rollable device having support sections with different radii and adapted to be rolled along a circular path on a game board having a "start/finish" line drawn from the center to one edge. The first player to complete ten laps is the winner.

The rollable device can also be used as a movable target by affixing a target for a projectile on one or both of the facing interconnected planar members of the rollable device of the type shown in FIGS. 1–4. When the device is rolled along an inclined surface any target thereon will be different to hit with a projectile.

I claim:

1. A rollable article consisting of two interconnected generally symmetrical sections of about equal weight which extend outwardly in diametrically opposite directions and each providing an outer supporting edge surface in the form of an arc having a length of about 180° with each supporting edge surface laying in separate intersecting planes which intersect one of said supporting edge surfaces midway between the ends thereof, and said article having no portion thereof providing support therefor other than said edge surfaces when the said article is placed on a planar surface; whereby said article exhibits a wobbling motion when rolled along an inclined planar surface.

2. A rollable article as in claim 1, wherein each supporting edge surface also is in a plane perpendicular to a plane containing the ends of the other supporting edge surfaces.

3. A rollable article as in claim 1 or 2, wherein each of said sections has a generally planar semi-circular form.

4. A rollable article as in claim 1, 2 or 3, wherein said members are symmetrical.

5. A rollable device as in claim 1 or 2, wherein said sections have different radii.

6. A rollable article as in claim 1 or 2, wherein the lateral surface of each said sections is defined by lines having a concave curvature extending from each supporting edge surface to the opposite ends of the other supporting edge surface.

7. A rollable article as in claim 1 or 2, wherein each said member comprises a length of a form-retaining rod in the form of a semi-circular arc of about 180° in length having a support surface along its outer surface and said members being interconnected by at least one rigid element.

8. A rollable article as in claim 5, wherein said sections are interconnected at their mid-points by a said element which has a length about equal to the length of the diameter line of said semi-circular arc.

9. A rollable article as in claim 7, wherein said sections are interconnected by a rigid element which allows moving said sections pivotally about the longitudinal axis of said rigid element.

10. A rollable article as in claim 1, wherein said sections are formed of flat semi-circular sections of rigid material which are interconnected by having the straight edge portion thereof extending perpendicularly outwardly from the opposite sides of a generally square planar section having a diagonal of the same length as the diameter of the said semi-circular sections with the sides of said square section being slightly concave between the corners thereof to avoid said sides making contact with a support surface on which the rollable device is placed and the said semi-circular sections extending outwardly from perpendicular diagonals of the said square section.

* * * * *